US005105946A

United States Patent [19]

McDowell

[11] Patent Number: 5,105,946

[45] Date of Patent: Apr. 21, 1992

[54] FRONT OPENING CONTAINER

[75] Inventor: Richard B. McDowell, Ligonier, Pa.

[73] Assignee: Menasha Corporation, Neenah, Wis.

[21] Appl. No.: 564,482

[22] Filed: Aug. 8, 1990

[51] Int. Cl.[5] ..... B65D 85/48

[52] U.S. Cl. ..... 206/454; 206/386; 206/597; 206/449

[58] Field of Search ..... 206/386, 320, 326, 448, 206/449, 451, 453, 454, 600, 597; 211/41

[56] References Cited

U.S. PATENT DOCUMENTS

| | | | |
|---|---|---|---|
| 2,171,051 | 8/1939 | Stonecypher | 229/35 |
| 2,331,753 | 10/1943 | Wohlers | 206/326 |
| 2,665,804 | 1/1954 | Koester | 206/62 |
| 2,673,023 | 3/1954 | Vander Lugt, Jr. | 229/41 |
| 2,734,626 | 2/1956 | Koester et al. | 206/62 |
| 2,743,010 | 4/1956 | Koester | 206/62 |
| 2,806,592 | 9/1957 | Hatfield | 206/62 |
| 2,839,198 | 6/1958 | Lefevre | 211/41 |
| 2,981,407 | 4/1961 | Gaulke et al. | 206/62 |
| 3,159,275 | 12/1964 | Van Antwerpen et al. | 206/448 |
| 3,403,778 | 10/1968 | Voytko et al. | 206/448 |
| 3,469,762 | 9/1969 | La Torre | 229/32 |
| 3,476,303 | 11/1969 | Smith | 229/31 |
| 3,493,128 | 2/1970 | Silvert | 214/10.5 |
| 3,519,244 | 7/1970 | Lidgard | 248/119 |
| 3,616,986 | 10/1971 | Wolfe | 206/320 |
| 3,884,356 | 5/1975 | Lidgard | 206/521 |
| 3,938,660 | 2/1976 | Moehring | 206/448 |
| 3,985,231 | 10/1976 | Farhat et al. | 206/448 |
| 4,014,435 | 3/1977 | Rowley et al. | 206/386 |
| 4,086,263 | 4/1978 | Rowley | 206/454 |
| 4,098,401 | 7/1978 | Brown et al. | 206/326 |
| 4,225,043 | 9/1980 | Lastik | 206/448 |
| 4,317,536 | 3/1982 | Dickerson | 229/34 |
| 4,467,922 | 8/1984 | Rowley | 206/449 |
| 4,477,015 | 10/1984 | Lozaun | 229/23 |
| 4,489,835 | 12/1984 | Tombal et al. | 211/41 |
| 4,697,731 | 10/1987 | Snyder | 229/23 |

FOREIGN PATENT DOCUMENTS

| | | | |
|---|---|---|---|
| 1097283 | 3/1981 | Canada | 206/326 |
| 1332546 | 10/1973 | United Kingdom | 206/448 |

OTHER PUBLICATIONS

Menasha Corporation brochure entitled "ARG Supplier Wins World Packaging Award", effective date prior to Dec. 1989.

*Primary Examiner*—David T. Fidei
*Attorney, Agent, or Firm*—Quarles & Brady

[57] ABSTRACT

A container for shipping sheets of glass or other fragile material wherein a cradle and a wedge are provided to maintain the sheets of glass in an upright position during shipment. Upon removal of the wedge, the sheets recline against the cradle for stability purposes during unloading. The container is of the front opening type and has interlocking members on the front and back portions to hold the front gate portion in a locked manner.

8 Claims, 3 Drawing Sheets

FIG. 3
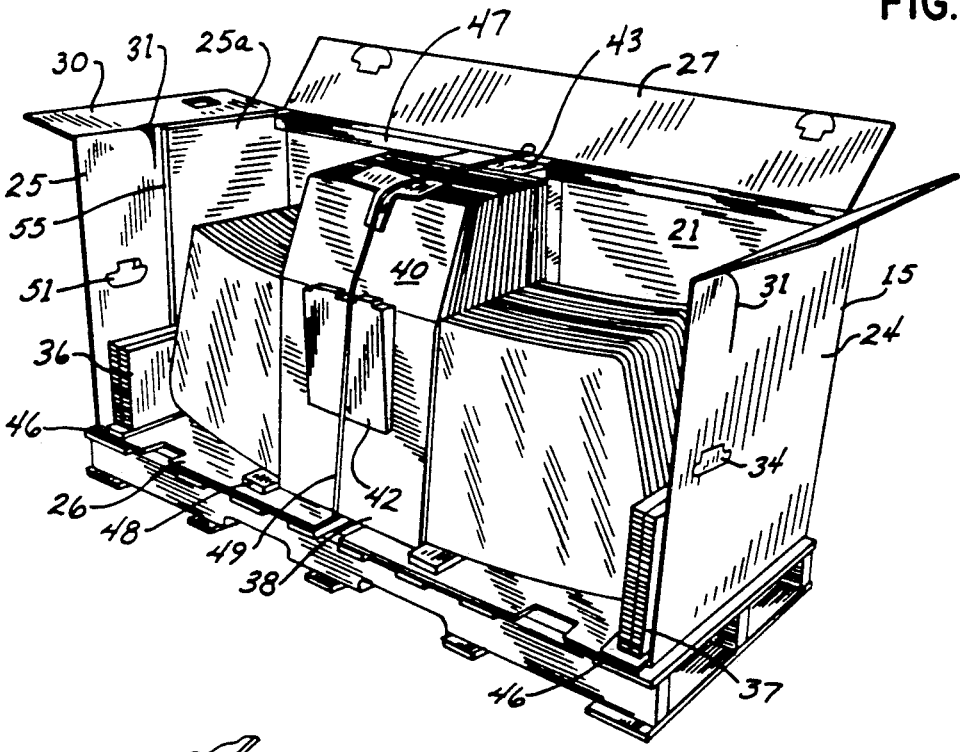
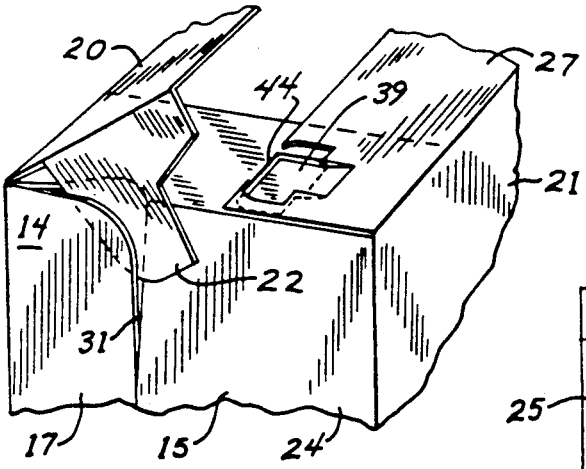
FIG. 4
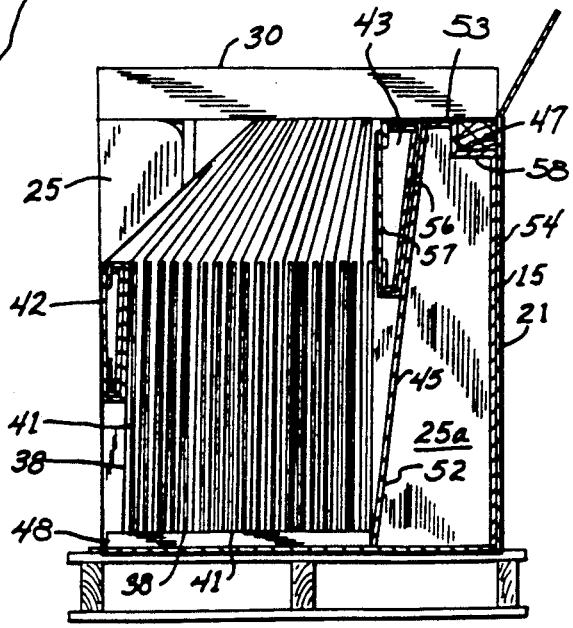
FIG. 5

FRONT OPENING CONTAINER

BACKGROUND OF THE INVENTION

The invention relates to a container for shipping and unloading fragile articles such as glass windshields, or the like. More particularly, the invention relates to a container which includes a cradle member and a wedge member for supporting the glass panels in a vertical position yet allows them to incline in the container for ease of unloading when the wedge member is removed.

Containers with a removable front panel are known. This is shown in U.S. Pat. No. 4,697,731. In U.S. Pat. No. 2,839,198 a wedge/clamp arrangement is disclosed wherein the wedge is in the front of the stack to hold it in an inclined position. In U.S. Pat. No. 3,493,128 inclined "cradles" are disclosed for transporting and handling fragile plates. U.S. Pat. No. 4,014,435 and 4,086,263 show the use of back support members for holding articles in an angled position.

The prior art does not provide any means by which fragile articles are supported in a container in a vertical position whereas to maximize the stacking strength of the separator material and at the same time afford an inclined stable position for the articles when they are unloaded.

It is an advantage of the present invention to provide a container system of the foregoing type which is readily adaptable to a front opening and unloading container.

It is yet another advantage of the invention to provide a container of the foregoing type wherein fragile articles can be moved from a vertical to an inclined position by the mere removal of a support member.

It is still a further advantage of the invention to provide a support cradle and a wedge member for fragile articles in a front opening contanier.

It is still another advantage of the invention to provide a front opening container wherein a front portion is firmly interlocked with a back portion by interlocking members so as to obviate the need for banding.

Other advantages of this invention are a container system of the foregoing type which can be manufactured at low cost and from readily available material and can be easily assembled and disassembled.

SUMMARY OF THE INVENTION

The foregoing advantages are accomplished and the shortcomings of the prior art are overcome by the present container for shipping sheets of glass or other fragile material in one position and for moving them to a second position for removal. The container includes a container boby having top, bottom, and upstanding side walls. The side walls are constructed and arranged to receive at least one sheet of the glass or other fragile sheet material therebewteen. A cradle member is positioned between the fragile sheet material and one of the side walls, and a wedge member is positioned between the cradle and the fragile sheet material. There are means to secure the wedge member between the cradle member and the fragile sheet material. In this manner, the fragile sheet material is positioned in a substantially upright position when the wedge member is present but is reclined against the cradle member when the wedge member is removed.

In a preferred embodiment, the cradle member inclines from the top of the container to the bottom so as to afford a reclining position of the fragile sheet material toward the back of the container when the wedge member is removed.

In one aspect of the invention, there is a second wedge member positioned on an opposite side of the fragile sheet material.

In still another aspect of the invention, the container includes a removable front portion with the front portion and the back portion being connected through their side walls by interlocking members.

Brief Description of the Drawings

A better understanding of the present container system will be accomplished by reference to the drawings wherein:

FIG. 2 is a perspective view showing the container system with the front portion removed illustrating the windshield members supported therein with the supporting filler members as well as the lateral supports.

FIG. 4 is an enlarged, partial, detailed view illustrating the interconnection between the front and the back portions as well as between the top and side panels.

FIG. 5 is a view in vertical section of the container system as shown in FIG. 3, and with the windshields shown supported in the vertical position for shipping purposes.

Description of Preferred Embodiment

Figure 1:
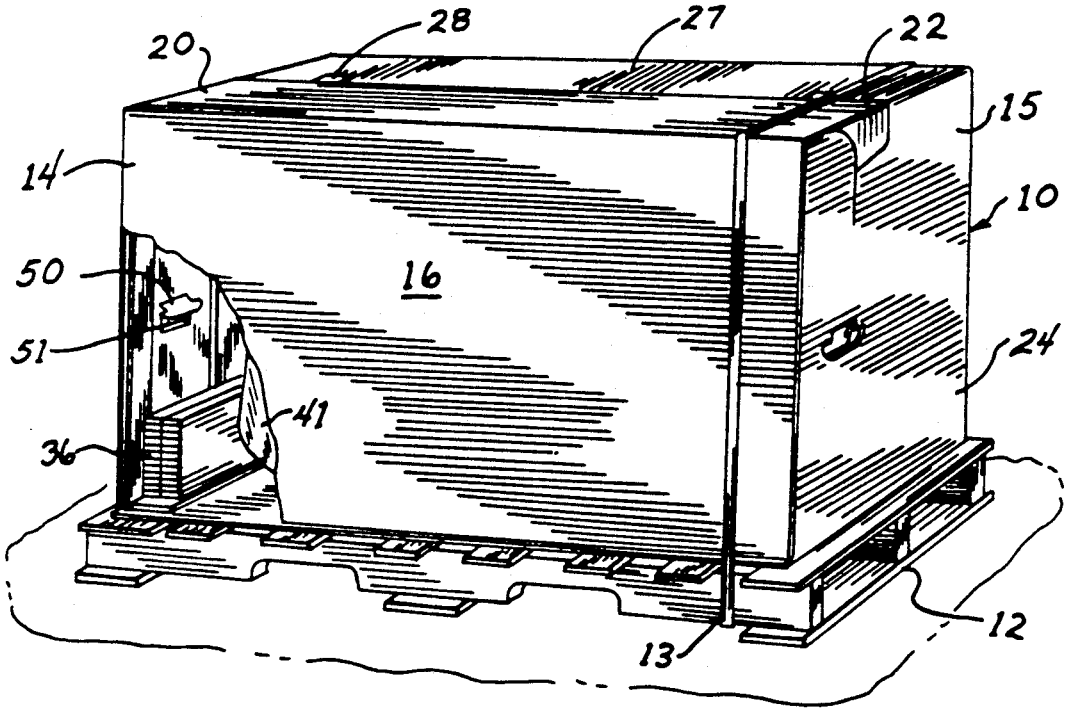
FIG. 1 is a persepctive view showing the container of this invention secured to a pallet and with a portion broken away to illustrate one of the windshields being supported therein.
Figure 2:
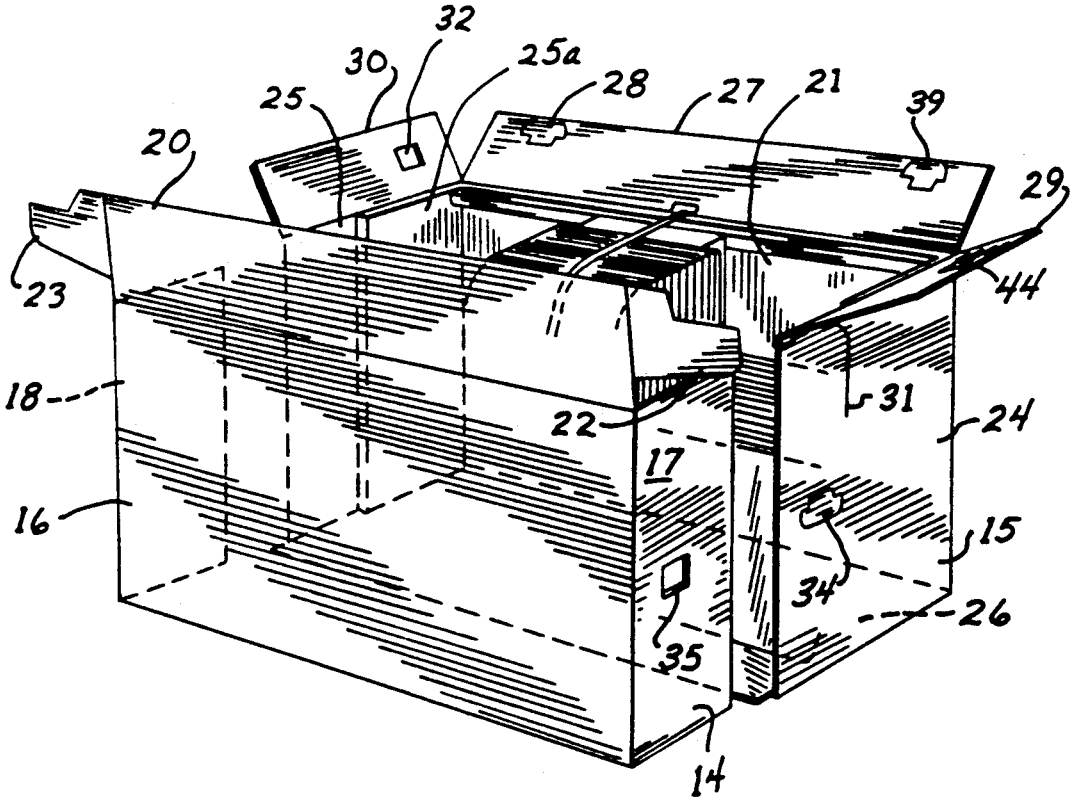
FIG. 2 is an assembly view in perspective of the container system shown in FIG. 1.

Proceeding to a detailed description of the present invention, and particularly FIGS. 1 and 2, the container generally 10 is adapted to be rigidly secured to a pallet 12 such as by the strapping 13 and stapling. The container system is basically a two component construction having a front removable portion 14 and a back portion 15. The front portion includes upstanding side walls as represented by a front side panel 16 as well as the pair of end walls 17 and 18. There is also a top panel 20 from which extends the end extension panel 22 and 23. The back portion 15 also has the upstanding side walls as represented by the pair of end walls 24 and 25, a bottom panel 26, as well as a back panel or side wall 21 and a top panel 27. Provided in top panel 27 are the flaps 28 and 39 for engagement in the openings 32 and 44 of the end panels 30 and 29, respectively. This is illustrated in FIG. 4. Also as best seen in FIG. 4 is the interengagement of the end extension panel 22 with the slit 31 in the end wall 24 which provides part of an interlocking between the front portion 14 and the back portion 15. Also providing an interlocking of the front portion 14 to the back portion 15 are the interlocking handle flaps 34 and 50 disposed in the end walls 24 and 25, respectively, for engagement in the openings 35 and 51 in the end walls 17 and 18, respectively.

Figure 6:
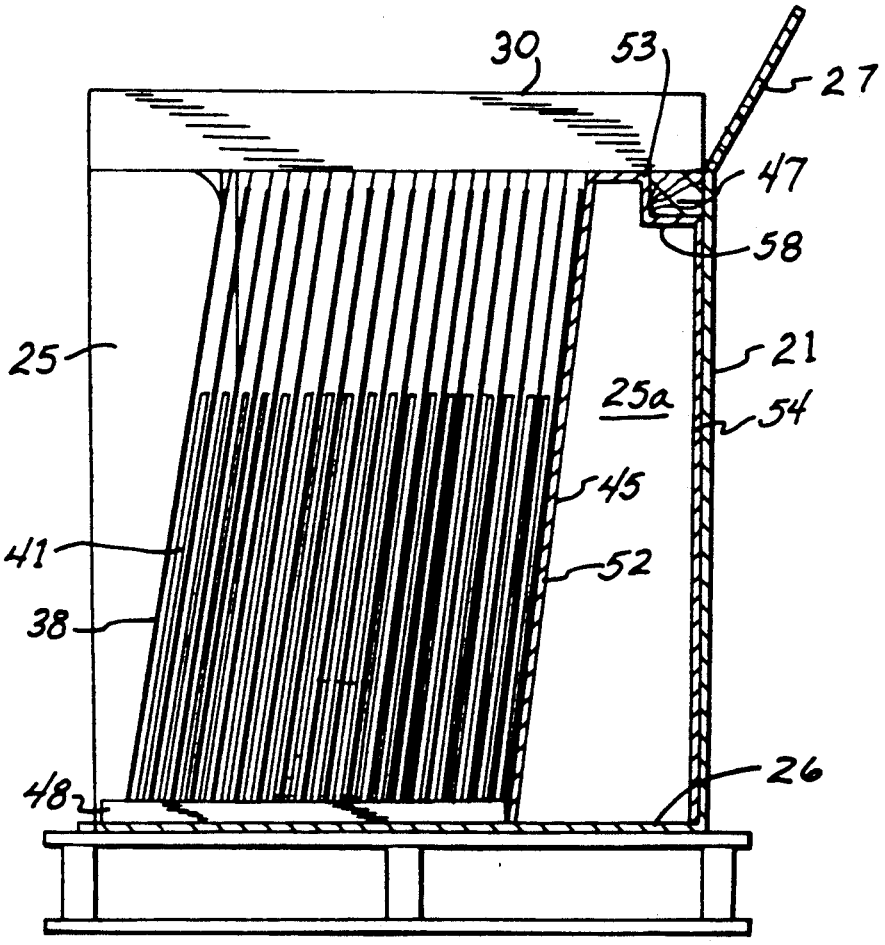
FIG. 6 is an enlarged view similar to FIG. 5 illustrating the windshields in a reclinded position for unloading purposes.

As best seen in FIGS. 3 and 5, the windshields 41 are supported by the filler materials 38 which are positioned on both sides thereof. A wedge member 42 is positioned against another filler member 38 at the front which assists in giving upright support to the windshields 41. Positioned at the back of the back portion 15 is a cradle member 45. Referring to FIGS. 5 and 6, cradle member 45 has the wall 52 which inclines downwardly from top to bottom. It also has the top wall portion 53 having an "L" shaped cut out 58 to accommodate the support rail 47. A back side wall 54 completes the structure of the cradle 45 which preferably does not have a base or floor. Placed between the cradle member 45 and the windshields 41 is a second wedge member 43 which is of a configuration to provide vertical support for the windshields. Wedge member 43 like wedge member 42 is formed from two, folded, commonly used interlocking portions 56 and 57. Strapping 49 binds the wedge member 42 and 43 to the windshields 41 and the filler materials 38 as well as securing the windshields against the cradle member 43 and to the back and bottom of the back portion 15.

It will be seen that the filler materials 38 have an extension portion 40 for securing them in the back portion 15. Also, there is positioned the unsecured packing 36 and 37 to give lateral support to the windshields 41 and the filler materials 38. Strips 46 are stapled through the bottom and panel 26 and to the pallet 12. This reinforces and aids in securing the container 10 to the pallet 12. Further, the windshields 41 and the filler materials 38 are supported on the floor 26 by the securing strips 48 which are also stapled to the pallet 12. An additional reinforcing panel **25*a* is secured to opposing ends and cross the back panel 21 of the back portion 15. The edge 55 of panel 25*a* provides a stop for the end walls 17 and 18 when they are interlocked with the end walls 24 and 25 of the back portion 15. Packing 36 and 37 is spaced inwardly from the end walls 24 and 25 to allow the end walls 17 and 18 to pass there between. Also, a reinforcing rail 47 extends between the end walls 24 and 25 and along the back wall 21**.

An important feature of the container 10 is best illustrated in conjunction with FIGS. 5 and 6. FIG. 5 shows the windshields 41 as supported in the vertical position. In this manner, the packing strength of the filler materials 38 is maximized during shipment. It will be seen that this vertical positioning is assisted by the back wedge member 43 and the front wedge member 42. When the container system reaches its destination and it is desired to unload the windshields 41, the front portion 14 is removed as indicated in FIG. 2 to result in the container system as shown in FIG. 3. The strapping 49 would then be released and the wedges 42 and 43 removed. With their removal, the windshields 41 and the filler materials 38 would be moved backward, or from left to right as viewed in FIG. 6. In this manner, the windshields 41 will be supported by the cradle 45 and specifically the inclined wall 52. They are thus placed in a stable position for removal without fear of them falling forward and breaking.

Another important feature of the container system is the interlocking of the front portion 14 or gate with the back portion 15. This is accomplished by the handle flaps 34 and 50 extending from the end walls 24 and 25 for engagement in the end walls 17 and 18 of the front portion 14 as well as the end panels 22 and 23 engaging in the slits such as 31 in the end walls 24 and 25. The interlocking obviates a belly banding of the back portion 15 with the front gate portion 14.

In the description of the container 10, certain interlocking relationships between the top panel 27 and the side panels 29 and 30 have been described. Obviously various other types of locking members could be employed without departing from the scope of the invention. Likewise, various other types of packing materials could be substituted such as for packing material 36. While front wedge 42 adds vertical stability to the windshields 41 and filler members 38, this could be eliminated as sufficient support could be given by the wedge member 43.

The preferred materials for forming the wedge members 42 and 43 as well as the cradle 45 is corrugate material. If desired, although more expensive, a wooden cradle member or one made of plastic could be substituted. Also, the cradle member 45 is depicted as having two sides and one top wall. A bottom or floor could be added if additional strength is warranted. Further, the "L" cut out 58 could be eliminated and the top wall portion 53 extended in a straight line under the rail 47. The cradle member 45 has the inclined wall 52 positioned at an angle of about 3½°. This angle could range from 3½° to 5° if desired and still afford the benefits of a reclining surface and a vertical support with the wedge 43. While windshields 41 have been illustrated for use with the container system of this invention, obviously any other type of sheet like materials could be substituted where it is desired to ship and unload them in the previously described manner. Further container 10 is preferably of a rectangular shape which allows for a wider opening at the front when the front portion is removed. Obviously other geometric configurations could be utilized and still afford the advantages of the container.

It will thus be seen through the present invention there is now provided a container system which affords a two stage positioning for the transported articles. The container system can be fabricated from readily available materials and without the need of special tooling. Access to the container is easily afforded by utilizing the two stage procedure in conjunction with a front opening container wherein the front gate portion is locked thereto in a secure manner. Further, the two stage positioning which is afforded by the container system of this invention is operable with various types of materials and with various sizes of containers.

I claim:

1. A container for shipping sheets of material comprising:

a container body defining top, bottom, back and upstanding corrugated side walls;

the side walls being constructed and arranged to receive at least one sheet of fragile material therebetween;

an elongated reinforcing member extending between two opposing side walls and across an upper interior portion of said back wall;

a cradle member positioned between said sheet and said back wall, said cradle member composed of a corrugated material having spaced front and rear walls, a top portion contacting said reinforcing member, said cradle member rear wall adjacent said back wall and having an inclined front wall extending in a direction away from said reinforcing member wherein the dimension between said front and rear walls increases from said top portion to the container bottom; and means to secure said sheet of fragile material against said cradle member and said cradle member against said reinforcing member.

2. The container as defined in claim 1 further including a removable wedge member positioned between said cradle member and said sheet to support said sheet in a substantially upright position.

3. The container as defined in claim 2 further including a second wedge member positioned at an opposite side of said sheet.

4. The container as defined in claim 3 further including resilient filler members adapted to be positioned on opposite sides of said sheet.

5. The container as defined in claim 4 further including said filler members positioned between said wedge members and said sheet.

6. The container as defined in claim 1 wherein said cradle member has an "L" shaped cut out to accommodate said reinforcing member.

7. The container as defined in claim 1 wherein said means to secure said sheet of fragile material against said cradle member and said cradle member against said reinforcing member is a single strap means.

8. A container for shipping sheets of material in one position and for moving them to a second position for removal comprising:

a container body defining top, bottom and upstanding side walls;

the side walls being constructed and arranged to receive at least one sheet of fragile material therebetween;

the container including a removable front portion which is connected to said side walls by interlocking handle members and panels members for engagement in slots in said side walls;

a cradle member positioned between said sheet and one of said walls;

a wedge member positioned between said cradle and said sheet; and means to secure said wedge member against said cradle member;

so that the sheet material is positioned in a substantially upright position when the wedge member is present but is inclined against the cradle member when the wedge member is removed.

* * * * *